US009927114B2

(12) United States Patent
Dellock et al.

(10) Patent No.: US 9,927,114 B2
(45) Date of Patent: Mar. 27, 2018

(54) ILLUMINATION APPARATUS UTILIZING CONDUCTIVE POLYMERS

(71) Applicant: Ford Global Technologies, LLC, Dearborn, MI (US)

(72) Inventors: Paul Kenneth Dellock, Northville, MI (US); Harry Lobo, Canton, MI (US); Stuart C. Salter, White Lake, MI (US); Michael Musleh, Canton, MI (US); Talat Karmo, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 156 days.

(21) Appl. No.: 15/002,716

(22) Filed: Jan. 21, 2016

(65) Prior Publication Data

US 2017/0211802 A1 Jul. 27, 2017

(51) Int. Cl.

| | |
|---|---|
| ***F21V 29/87*** | (2015.01) |
| ***F21V 29/74*** | (2015.01) |
| ***F21S 4/28*** | (2016.01) |
| ***H05B 33/04*** | (2006.01) |
| ***H05B 33/06*** | (2006.01) |
| *F21Y 103/10* | (2016.01) |
| *F21Y 115/10* | (2016.01) |
| *F21W 101/02* | (2006.01) |

(52) U.S. Cl.

CPC ..... *F21V 29/87* (2015.01); *F21S 4/28* (2016.01); *F21V 29/74* (2015.01); *H05B 33/04* (2013.01); *H05B 33/06* (2013.01); *F21W 2101/02* (2013.01); *F21Y 2103/10* (2016.08); *F21Y 2115/10* (2016.08)

(58) Field of Classification Search

CPC ..... F21V 29/87; F21V 29/74; H05B 33/04; H05B 33/06

See application file for complete search history.

(56) References Cited

U.S. PATENT DOCUMENTS

| | | | |
|---|---|---|---|
| 2,486,859 | A | 11/1949 | Meijer et al. |
| 5,053,930 | A | 10/1991 | Benavides |
| 5,434,013 | A | 7/1995 | Fernandez |
| 5,709,453 | A | 1/1998 | Krent et al. |
| 5,839,718 | A | 11/1998 | Hase et al. |
| 6,031,511 | A | 2/2000 | DeLuca et al. |
| 6,117,362 | A | 9/2000 | Yen et al. |
| 6,419,854 | B1 | 7/2002 | Yocom et al. |
| 6,494,490 | B1 | 12/2002 | Trantoul |

(Continued)

FOREIGN PATENT DOCUMENTS

| | | | |
|---|---|---|---|
| CN | 101337492 | A | 1/2009 |
| CN | 201169230 | Y | 2/2009 |

(Continued)

*Primary Examiner* — Anne Hines

(74) *Attorney, Agent, or Firm* — Jason Rogers; Price Heneveld LLP

(57) ABSTRACT

A light emitting assembly is disclosed. The light emitting assembly comprises a first electrode and a second electrode extending parallel to the first electrode. The assembly further comprises an LED strip comprising a plurality of LEDs in a semiconductor ink disposed on the first electrode and the second electrode and configured to emit a first emission. The first electrode and the second electrode are of an electrically conductive polymer configured to transfer heat away from the plurality of LEDs.

19 Claims, 6 Drawing Sheets

(56) References Cited

U.S. PATENT DOCUMENTS

| | | | |
|---|---|---|---|
| 6,577,073 | B2 | 6/2003 | Shimizu et al. |
| 6,729,738 | B2 | 5/2004 | Fuwausa et al. |
| 6,737,964 | B2 | 5/2004 | Samman et al. |
| 6,773,129 | B2 | 8/2004 | Anderson, Jr. et al. |
| 6,820,888 | B1 | 11/2004 | Griffin |
| 6,851,840 | B2 | 2/2005 | Ramamurthy et al. |
| 6,859,148 | B2 | 2/2005 | Miller |
| 6,871,986 | B2 | 3/2005 | Yamanaka et al. |
| 6,953,536 | B2 | 10/2005 | Yen et al. |
| 6,976,769 | B2 | 12/2005 | McCullough et al. |
| 6,990,922 | B2 | 1/2006 | Ichikawa et al. |
| 7,015,893 | B2 | 3/2006 | Li et al. |
| 7,161,472 | B2 | 1/2007 | Strumolo et al. |
| 7,213,923 | B2 | 5/2007 | Liu et al. |
| 7,216,997 | B2 | 5/2007 | Anderson, Jr. |
| 7,249,869 | B2 | 7/2007 | Takahashi et al. |
| 7,264,366 | B2 | 9/2007 | Hulse |
| 7,264,367 | B2 | 9/2007 | Hulse |
| 7,441,914 | B2 | 10/2008 | Palmer et al. |
| 7,501,749 | B2 | 3/2009 | Takeda et al. |
| 7,575,349 | B2 | 8/2009 | Bucher et al. |
| 7,635,212 | B2 | 12/2009 | Seidler |
| 7,726,856 | B2 | 6/2010 | Tsutsumi |
| 7,745,818 | B2 | 6/2010 | Sofue et al. |
| 7,753,541 | B2 | 7/2010 | Chen et al. |
| 7,834,548 | B2 | 11/2010 | Jousse et al. |
| 7,862,220 | B2 | 1/2011 | Cannon et al. |
| 7,987,030 | B2 | 7/2011 | Flores et al. |
| 8,016,465 | B2 | 9/2011 | Egerer et al. |
| 8,022,818 | B2 | 9/2011 | la Tendresse et al. |
| 8,044,415 | B2 | 10/2011 | Messere et al. |
| 8,066,416 | B2 | 11/2011 | Bucher |
| 8,071,988 | B2 | 12/2011 | Lee et al. |
| 8,097,843 | B2 | 1/2012 | Agrawal et al. |
| 8,118,441 | B2 | 2/2012 | Hessling |
| 8,120,236 | B2 | 2/2012 | Auday et al. |
| 8,136,425 | B2 | 3/2012 | Bostick |
| 8,163,201 | B2 | 4/2012 | Agrawal et al. |
| 8,169,131 | B2 | 5/2012 | Murazaki et al. |
| 8,178,852 | B2 | 5/2012 | Kingsley et al. |
| 8,197,105 | B2 | 6/2012 | Yang |
| 8,203,260 | B2 | 6/2012 | Li et al. |
| 8,207,511 | B2 | 6/2012 | Bortz et al. |
| 8,232,533 | B2 | 7/2012 | Kingsley et al. |
| 8,247,761 | B1 | 8/2012 | Agrawal et al. |
| 8,261,686 | B2 | 9/2012 | Birman et al. |
| 8,286,378 | B2 | 10/2012 | Martin et al. |
| 8,305,225 | B2 | 11/2012 | Hefright et al. |
| 8,408,766 | B2 | 4/2013 | Wilson et al. |
| 8,415,642 | B2 | 4/2013 | Kingsley et al. |
| 8,421,811 | B2 | 4/2013 | Odland et al. |
| 8,466,438 | B2 | 6/2013 | Lambert et al. |
| 8,519,359 | B2 | 8/2013 | Kingsley et al. |
| 8,519,362 | B2 | 8/2013 | Labrot et al. |
| 8,539,702 | B2 | 9/2013 | Li et al. |
| 8,552,848 | B2 | 10/2013 | Rao et al. |
| 8,606,430 | B2 | 12/2013 | Seder et al. |
| 8,624,716 | B2 | 1/2014 | Englander |
| 8,631,598 | B2 | 1/2014 | Li et al. |
| 8,664,624 | B2 | 3/2014 | Kingsley et al. |
| 8,683,722 | B1 | 4/2014 | Cowan |
| 8,724,054 | B2 | 5/2014 | Jones |
| 8,754,426 | B2 | 6/2014 | Marx et al. |
| 8,773,012 | B2 | 7/2014 | Ryu et al. |
| 8,827,508 | B2 | 9/2014 | Sagal |
| 8,846,184 | B2 | 9/2014 | Agrawal et al. |
| 8,851,694 | B2 | 10/2014 | Harada |
| 8,876,352 | B2 | 11/2014 | Robbins et al. |
| 8,952,341 | B2 | 2/2015 | Kingsley et al. |
| 8,994,495 | B2 | 3/2015 | Dassanayake et al. |
| 9,006,751 | B2 | 4/2015 | Kleo et al. |
| 9,018,833 | B2 | 4/2015 | Lowenthal et al. |
| 9,057,021 | B2 | 6/2015 | Kingsley et al. |
| 9,059,378 | B2 | 6/2015 | Verger et al. |
| 9,065,447 | B2 | 6/2015 | Buttolo et al. |
| 9,187,034 | B2 | 11/2015 | Tarahomi et al. |
| 9,299,887 | B2 | 3/2016 | Lowenthal et al. |
| 9,315,148 | B2 | 4/2016 | Schwenke et al. |
| 9,568,659 | B2 | 2/2017 | Verger et al. |
| 9,616,812 | B2 | 4/2017 | Sawayanagi |
| 2002/0159741 | A1 | 10/2002 | Graves et al. |
| 2002/0163792 | A1 | 11/2002 | Formoso |
| 2003/0167668 | A1 | 9/2003 | Fuks et al. |
| 2003/0179548 | A1 | 9/2003 | Becker et al. |
| 2004/0213088 | A1 | 10/2004 | Fuwausa |
| 2005/0084229 | A1 | 4/2005 | Babbitt et al. |
| 2005/0189795 | A1 | 9/2005 | Roessler |
| 2006/0087826 | A1 | 4/2006 | Anderson, Jr. |
| 2006/0097121 | A1 | 5/2006 | Fugate |
| 2007/0032319 | A1 | 2/2007 | Tufte |
| 2007/0285938 | A1 | 12/2007 | Palmer et al. |
| 2007/0297045 | A1 | 12/2007 | Sakai et al. |
| 2009/0217970 | A1 | 9/2009 | Zimmerman et al. |
| 2009/0219730 | A1 | 9/2009 | Syfert et al. |
| 2009/0251920 | A1 | 10/2009 | Kino et al. |
| 2009/0260562 | A1 | 10/2009 | Folstad et al. |
| 2009/0262515 | A1 | 10/2009 | Lee et al. |
| 2010/0102736 | A1 | 4/2010 | Hessling |
| 2011/0012062 | A1 | 1/2011 | Agrawal et al. |
| 2012/0001406 | A1 | 1/2012 | Paxton et al. |
| 2012/0104954 | A1 | 5/2012 | Huang |
| 2012/0183677 | A1 | 7/2012 | Agrawal et al. |
| 2012/0280528 | A1 | 11/2012 | Dellock et al. |
| 2013/0050979 | A1 | 2/2013 | Van De Ven et al. |
| 2013/0092965 | A1 | 4/2013 | Kijima et al. |
| 2013/0335994 | A1 | 12/2013 | Mulder et al. |
| 2014/0003044 | A1 | 1/2014 | Harbers et al. |
| 2014/0029281 | A1 | 1/2014 | Suckling et al. |
| 2014/0065442 | A1 | 3/2014 | Kingsley et al. |
| 2014/0103258 | A1 | 4/2014 | Agrawal et al. |
| 2014/0211498 | A1 | 7/2014 | Cannon et al. |
| 2014/0240999 | A1* | 8/2014 | Roberts ..... B60Q 1/2615 362/510 |
| 2014/0264396 | A1 | 9/2014 | Lowenthal et al. |
| 2014/0266666 | A1 | 9/2014 | Habibi |
| 2014/0373898 | A1 | 12/2014 | Rogers et al. |
| 2015/0046027 | A1 | 2/2015 | Sura et al. |
| 2015/0109602 | A1 | 4/2015 | Martin et al. |
| 2015/0138789 | A1 | 5/2015 | Singer et al. |
| 2015/0267881 | A1 | 9/2015 | Salter et al. |
| 2016/0016506 | A1 | 1/2016 | Collins et al. |
| 2016/0102819 | A1 | 4/2016 | Misawa et al. |
| 2016/0131327 | A1 | 5/2016 | Moon et al. |
| 2016/0181476 | A1* | 6/2016 | Chang ..... H01L 25/0753 257/13 |
| 2016/0236613 | A1 | 8/2016 | Trier |
| 2017/0158125 | A1 | 6/2017 | Schuett et al. |

FOREIGN PATENT DOCUMENTS

| | | | |
|---|---|---|---|
| CN | 201193011 | Y | 2/2009 |
| CN | 204127823 | U | 1/2015 |
| DE | 4120677 | A1 | 1/1992 |
| DE | 29708699 | U1 | 7/1997 |
| DE | 10319396 | A1 | 11/2004 |
| EP | 1793261 | A1 | 6/2007 |
| EP | 2484956 | A1 | 8/2012 |
| EP | 2778209 | A1 | 9/2014 |
| JP | 2000159011 | A | 6/2000 |
| JP | 2007238063 | A | 9/2007 |
| KR | 20060026531 | A | 3/2006 |
| WO | 2006047306 | A1 | 5/2006 |
| WO | 2014068440 | A1 | 5/2014 |
| WO | 2014161927 | A1 | 10/2014 |

* cited by examiner

ILLUMINATION APPARATUS UTILIZING CONDUCTIVE POLYMERS

FIELD OF THE INVENTION

The present disclosure generally relates to vehicle lighting systems, and more particularly, to vehicle lighting systems having thin profiles that may be operable to conform to flexible materials and/or surfaces.

BACKGROUND OF THE INVENTION

Lighting in vehicles traditionally has been applied to provide illumination for reading, vehicle entry, and operation. However, lighting may also be applied to improve vehicle features and systems to ensure that vehicle passengers, operators, and onlookers have an improved experience. Such improvements may arise from improvements in safety, visibility, aesthetics, and/or features. The disclosure provides for a lighting system that may be operable to illuminate a portion of a vehicle. In some embodiments, the disclosure may provide for a lighting apparatus operable to emit a high intensity emission of light having at least one heat-dispersing electrode forming a base layer.

SUMMARY OF THE INVENTION

According to one aspect of the present disclosure, a light emitting assembly is disclosed. The light emitting assembly comprises a first electrode and a second electrode extending parallel to the first electrode. The assembly further comprises an LED strip comprising a plurality of LEDs in a semiconductor ink disposed on the first electrode and the second electrode and configured to emit a first emission. The first electrode and the second electrode are of an electrically conductive polymer configured to transfer heat away from the plurality of LEDs.

According to another aspect of the present disclosure, an extruded light bar is disclosed. The light bar comprises a first electrode, a second electrode, and a dielectric spacer separating the electrodes. The light bar further comprises an LED strip disposed on a first surface formed by the first electrode, the second electrode, and the dielectric spacer. A seal layer is disposed over the LED strip. The first electrode and the second electrode are of an electrically conductive polymer configured to transfer heat away from the LED strip.

According to yet another aspect of the present disclosure, an extruded light bar is disclosed. The light bar comprises a first electrode, a second electrode, and a dielectric spacer separating the electrodes. An LED strip is disposed on a substrate surface formed by the first electrode, the second electrode, and the dielectric spacer. The first electrode, the second electrode, and the dielectric spacer are of a plurality of polymers configured to transfer heat away from the LED strip.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

As required, detailed embodiments of the present disclosure are disclosed herein. However, it is to be understood that the disclosed embodiments are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
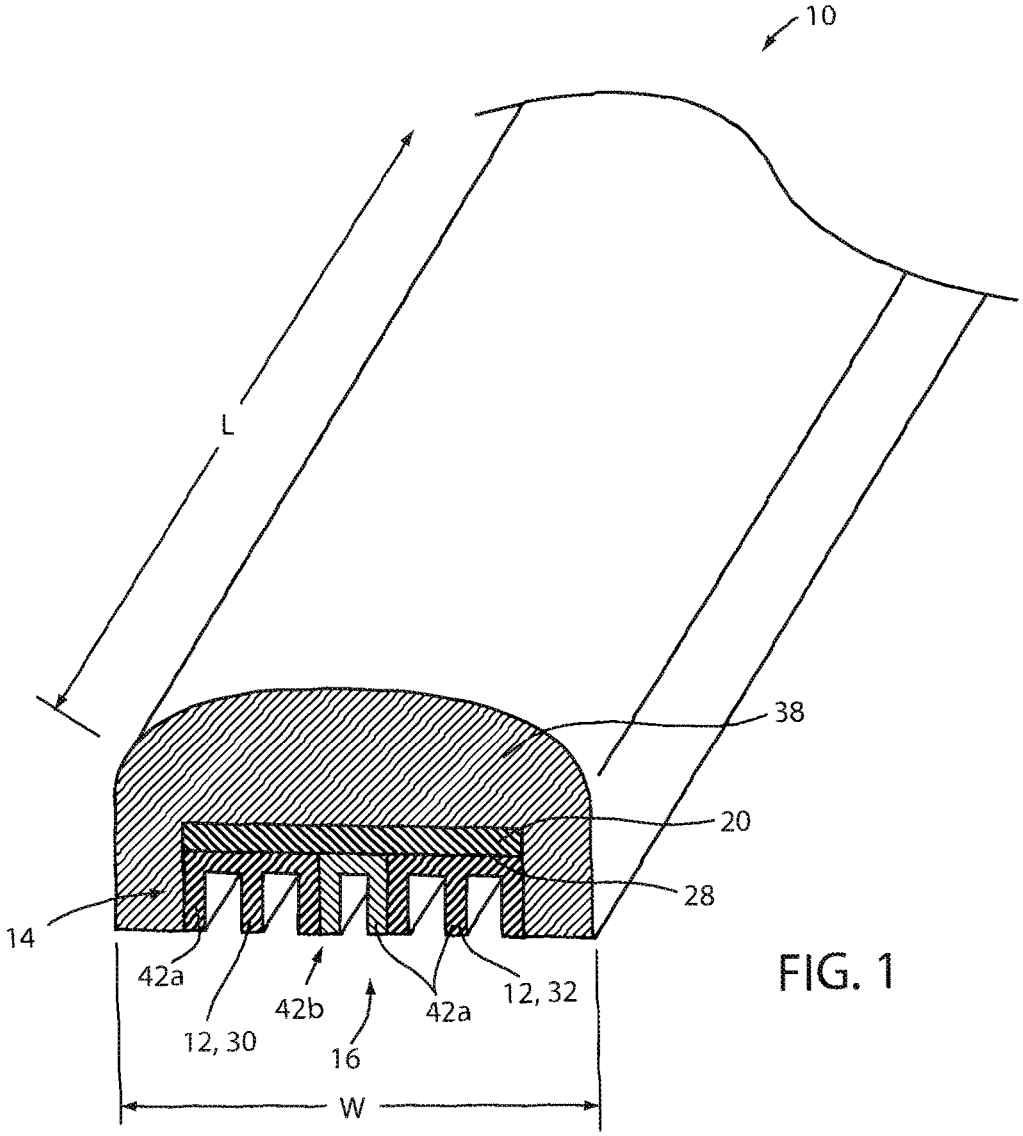
FIG. 1 is an pictorial view of an illumination apparatus in the form of an extruded light bar.

Referring to FIGS. 1 and 2, the disclosure describes an illumination apparatus 10. The illumination apparatus 10 may be configured to illuminate a portion of a vehicle and in some embodiments may be configured to illuminate at least one running light, headlight, and/or brake light. FIG. 1 is pictorial view of the illumination apparatus 10 in the form of an extruded light bar. FIG. 2 is a detailed cross-sectional view of the illumination apparatus 10. The illumination apparatus may be utilized in various applications to provide for an affordable lighting solution that may provide versatile lighting options for various applications.

The illumination apparatus 10 comprises at least one heat-dispersing electrode 12 forming a base layer 14. The heat-dispersing electrode 12 may correspond to an integral heat sink 16. The heat sink 16 may be configured to transmit heat away from a plurality of light emitting diode (LED) light sources 18 disposed in an LED strip 20. On a surface of the heat dispersing electrode 12 opposing the LED strip 20, a conformal layer or coating may be applied to protect the electrodes 12. In this configuration, the heat sink 16 may be configured to transmit heat away from the LED strip 20 to an environment proximate the illumination apparatus 10. In this way, the LED light sources 18 may be controlled by a controller 22 to emit a high intensity output emission 24 while preserving the longevity of the LED light sources 18.

The LED strip 20 may be disposed on a substrate 26 disposed on a substrate surface 28 of the at least one heat-dispersing electrode 12. The at least one heat-dispersing electrode 12 may correspond to a first electrode 30 configured to form a circuit with a second electrode 32 such that the controller 22 may selectively activate the LED light sources 18. The first electrode 30 may be in communication with the controller 22 (FIG. 4) via a first electrical lead 34, and the second electrode 32 may be in communication with the controller 22 via a second electrical lead 36. The first electrical lead 34 and the second electrical lead 36 may each be disposed in or formed as a portion of the first electrode 30 and the second electrode, respectively.

The first electrode 30 and the second electrode 32 may be of thermally conductive polymers that also conduct electricity. The electrodes 30 and 32 may be of an extrusion-grade thermally conductive and electrically conductive polymer. For example, commercially available polymers that are electrically and thermally conductive may include various standard polymers such as polypropylene, polycarbonate, and nylon that have been modified with fillers such as carbon black, graphite, carbon nanotubes, graphite or various metals. Specific examples of thermally and electrically conductive polymers include Celanese CoolPoly E Series materials or RTP conductive materials. Such materials may have a volume resistivity greater 1.0E2 Ohm.cm when measured to ASTM D257 standard.

The first electrode 30 and the second electrode 32 may be of thermally conductive polymers that also conduct electricity. The electrical surface conductivity of the electrodes 30 and 32 may be approximately $1\times10^{-3}$ to $1\times10^{-1}$ S/cm. Conventional polymers may typically have an electrical surface conductivity of about $1\times10^{-13}$ to $1\times10^{-18}$ S/cm. In some embodiments, the electrical surface conductivity of the electrodes 30 and 32 may be approximately $1\times10^{-2}$ S/cm. The thermal conductivity of the electrodes 30 and 32 may be approximately 5 to 100 W/mK. Conventional polymers (e.g. polypropylene and nylon) may have a thermal conductivity of approximately 0.15 to 0.25 w/mK. In an exemplary embodiment, the electrodes 30 and 32 may have a thermal conductivity of approximately 10-20 W/mK. The dielectric spacer 40 may have a similar thermal conductivity to the electrodes 30 and 32.

The first electrical lead 34 and the second electrical lead 36 may extend significantly along a length L of the illumination apparatus 10. In this configuration, the electrical leads 34 and 36 may provide for the LED light sources 18 to be consistently supplied current and illuminated along the length L of the illumination apparatus 10. While the electrical leads 34 and 36 may efficiently carry current from the controller 22 along the length L of the illumination apparatus 10, the first electrode 30 and the second electrode 32 may provide for the current to be dispersed along a width W of the illumination apparatus 10. In this configuration, the illumination apparatus 10 may be configured to provide consistent illumination along various lengths while limiting the cost of the electrical leads 34 and 36 based on the reduced material relative to a cross-sectional area A of each of the heat-dispersing electrodes 12.

The illumination apparatus 10 may further comprise a cover portion, for example an encapsulating layer 38, which may seal the LED strip 20 to the first electrode 30 and the second electrode 32. Though referred to as the encapsulating layer 38, the cover portion may correspond to a partial cover that may partially enclose the illumination apparatus 10. As discussed further in reference to FIG. 3, the encapsulating layer 38 may be extruded in a manufacturing process with the first electrode 30 and the second electrode 32. Additionally, a dielectric spacer 40 may be extruded between the first electrode 30 and the second electrode 32. In this configuration, the encapsulating layer 38 may enclose the LED strip 20 as well and the substrate 26 during an extrusion process. Additionally, the first electrode 30, the second electrode 32, and the dielectric spacer 40 may enclose the substrate surface 28 and adhere to the encapsulating layer 38 during the extrusion process.

The encapsulating layer 38 of the illumination apparatus 10 may correspond to a polymeric material configured to substantially seal the illumination apparatus 10 forming an enclosed or sealed assembly. The encapsulating layer 38 may correspond to a substantially light transmissive or transparent polymeric material molded over the LED strip 20. The transparent polymeric material may correspond to an acrylic, polycarbonate or other polymeric material that is at least partially light transmissive. In some embodiments, the encapsulating layer 38 may be of a thermally conductive polymer, such as a thermally conductive injection molding grade thermoplastic. In this configuration, the illumination apparatus 10 may be protected in a sealed configuration and the thermally conductive polymer may provide for the LED light sources 18 of the LED strip 20 to disperse heat for efficient operation when implemented in the sealed assembly.

The dielectric spacer 40 may be formed of a plastic that is a thermally conductive insulator. The dielectric spacer 40 may be formed from an extrusion-grade, thermally conductive and electrically insulating polymer. For example, commercially available polymers that are electrical insulators and thermally conductive may include polypropylene, polycarbonate, and nylon that have been modified with fillers such as ceramics. Examples of such polymers may include Celanese CoolPoly D Series or RTP Heat conductive/electrically insulating materials. Such materials may have a volume resistivity greater than 1.0E12 Ohm.cm when measured to ASTM D257 standard.

The first electrode 30, the second electrode 32, and/or the dielectric spacer 40 may be formed in an extrusion process and comprise at least one protrusion. As illustrated in the exemplary embodiment shown in FIG. 1, each of the first electrode 30, the second electrode 32, and the dielectric spacer 40 form a plurality of protrusions 42*a*. Each of the protrusions 42*a* may form a cooling surface 42*b* and may correspond to a cooling fin. The protrusions 42*a* may be configured to increase the surface area of the cooling surface 42*b* for the heat conductive materials of the first electrode 30, the second electrode 32, and/or the dielectric spacer 40 to cool the LED strip 20. In this configuration, the first electrode 30, the second electrode 32, and/or the dielectric spacer 40 may form a heat sink having a cooling rate or volumetric cooling capacity that may be optimized to the cooling rate required for the LED strip 20.

As discussed previously, in an exemplary embodiment, the illumination apparatus 10 may be in communication with the controller 22. The controller 22 may further be in communication with various control modules and systems of the vehicle. In this configuration, the controller 22 may selectively illuminate the illumination apparatus 10 to correspond to one or more states of the vehicle. A state of the vehicle may correspond to at least one of a locked/unlocked condition, a lighting condition, a driving condition, a drive gear selection, a door ajar condition, or any other condition that may be sensed by various control modules and systems of the vehicle. The various configurations of the illumination apparatus 10 may provide for beneficial lighting configured to illuminate at least a portion of the vehicle.

Figure 2A:
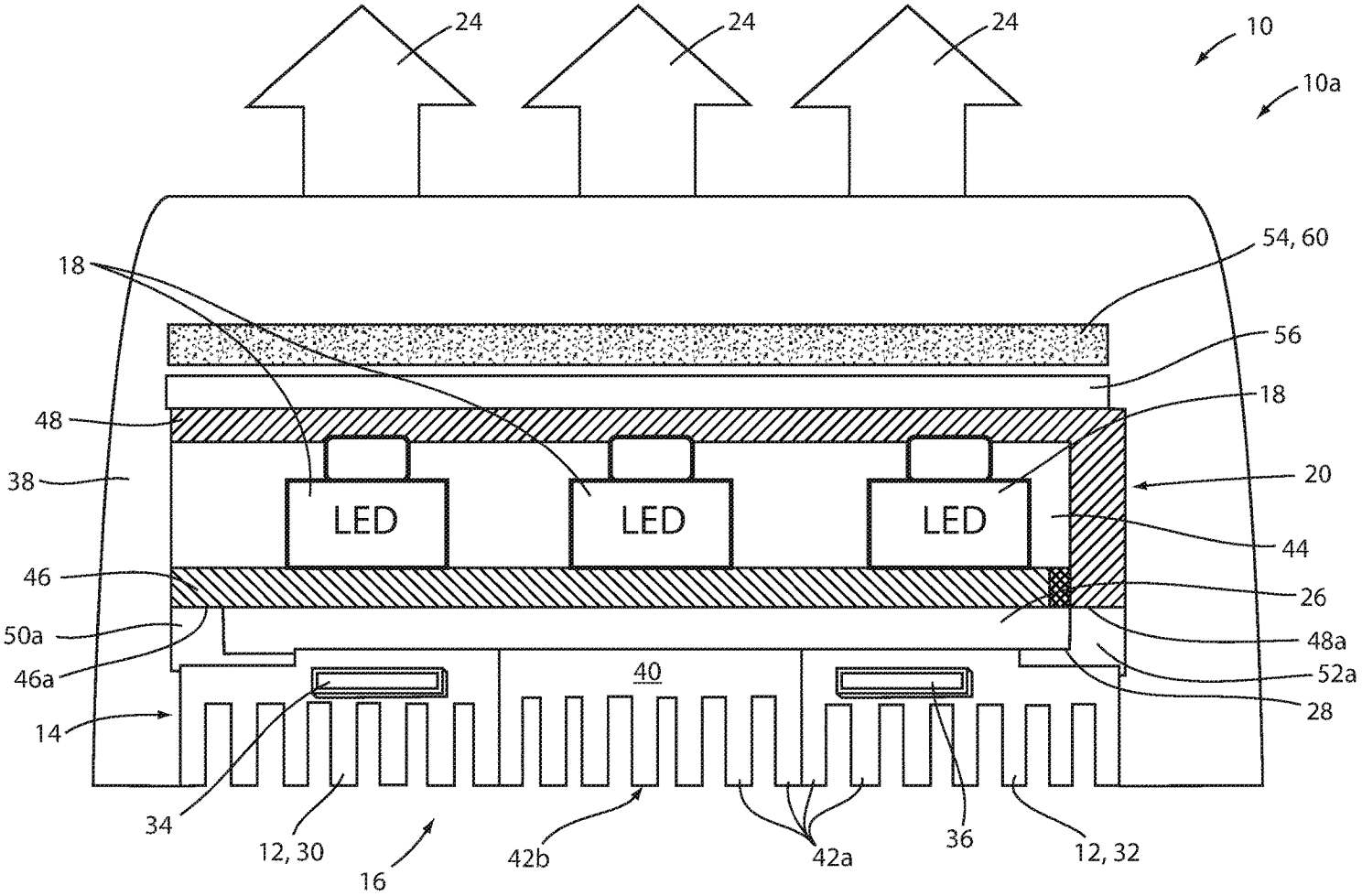
FIG. 2A is a detailed cross-sectional view of an illumination apparatus configured to selectively illuminate an interior cavity of a storage compartment.
Figure 2B:
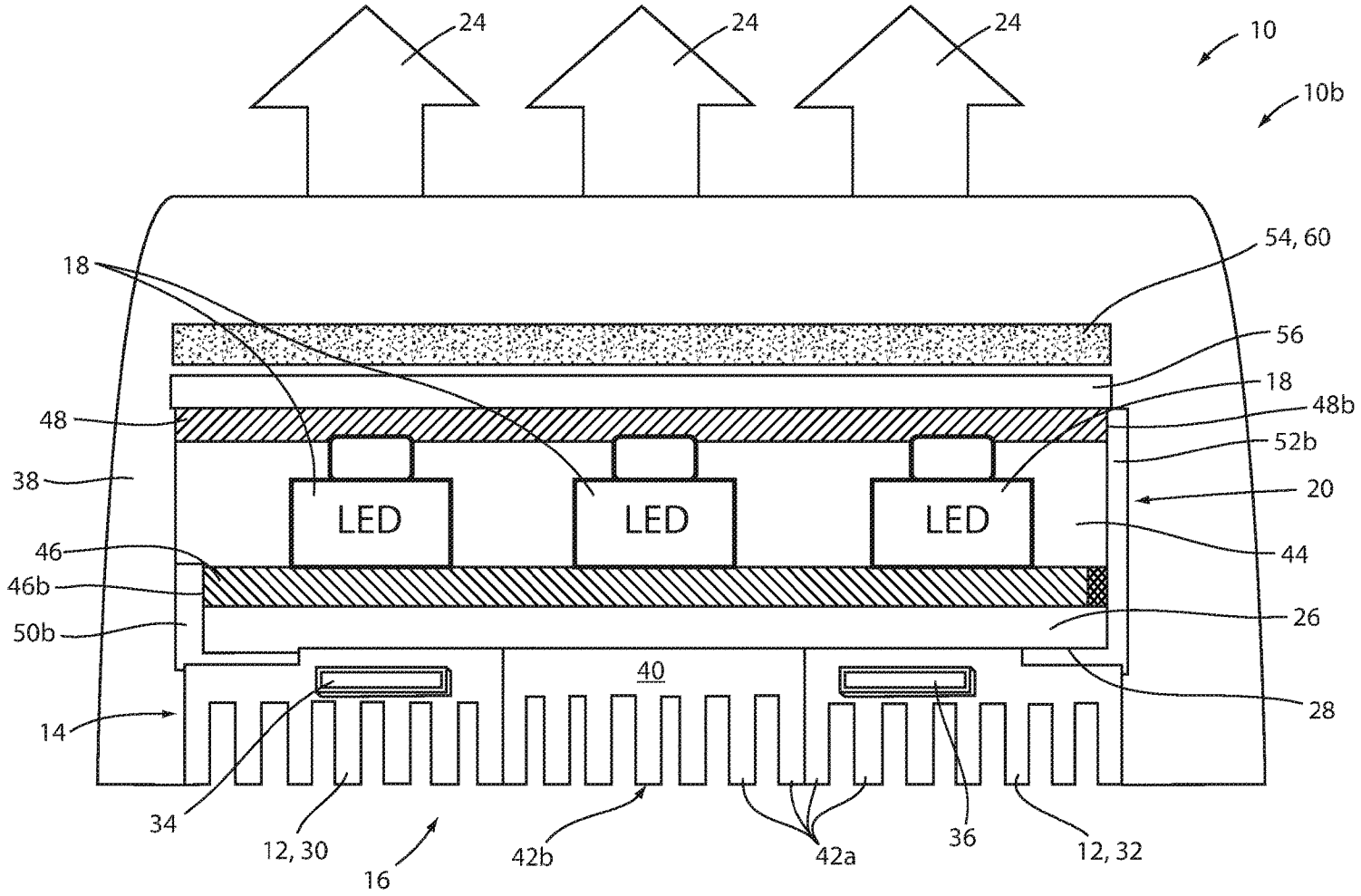
FIG. 2B is a detailed cross-sectional view of an illumination apparatus configured to selectively illuminate an interior cavity of a storage compartment.
Figure 2C:
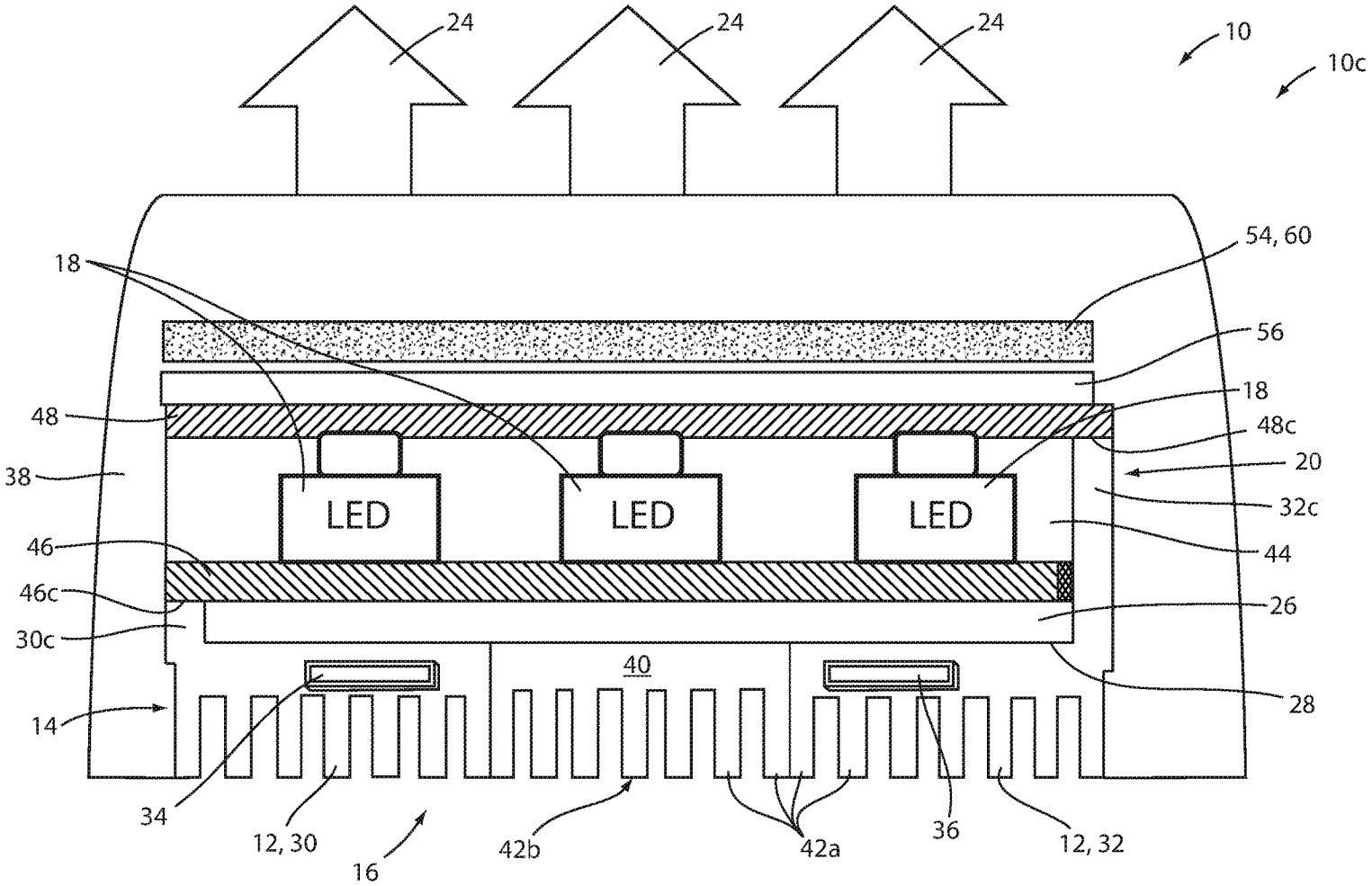
FIG. 2C is a detailed cross-sectional view of an illumination apparatus configured to selectively illuminate an interior cavity of a storage compartment.

Referring to FIGS. 2A, 2B, and 2C, the illumination apparatus 10 is shown in a plurality of exemplary embodiments. For clarity, the embodiments of the illumination apparatus 10 are designated as a first lighting assembly 10*a*, a second lighting assembly 10*b*, and a third lighting assembly 10*c* corresponding to the FIG. 2A, FIG. 2B, and FIG. 2C, respectively. Though designated as a first, second, etc., the specific constructions of the assemblies 10*a*, 10*b*, and 10*c* may be altered or combined based on the teaching disclosed depending on a desired construction. As such, common portions of the assemblies 10*a*, 10*b*, and 10*c* are like numbered and discussed concurrently to promote understanding.

As demonstrated in each of the assemblies 10*a*, 10*b*, and 10*c*, the illumination apparatus 10 may be in communication with the controller 22 via the electrical leads 34 and 36. The electrical leads 34 and 36 may correspond to conductive elements and/or conduits of metallic and/or conductive materials. The conductive materials may mold into the electrodes 30 and 32 in an extrusion process. The electrodes 30 and 32 may be utilized in the illumination apparatus 10 to conductively connect a plurality of LED light sources 18 of the LED strip 20 to a power source via the controller 22. In this way, the first electrical lead 34, the second electrical lead 36, and other connections in the illumination apparatus 10, may be configured to uniformly deliver current along the length L.

The LED light sources 18 may form an integral portion of the LED strip 20, which may be printed on the substrate 26. The LED strip 20 may be fed into an extruder wherein the LED strip 20 may receive the electrodes 30 and 32 as well as the dielectric spacer 40 during an extrusion process. In this configuration, a heat conductive materials of the electrodes 30 and 32 as well as the dielectric spacer 40 may provide for heat energy to be transmitted away from the LED light sources 18. Further details of the extrusion process are discussed in reference to FIG. 3.

The LED light sources 18 may be printed, dispersed or otherwise applied to via a semiconductor ink 44. The semiconductor ink 44 may be applied to a first conductive layer 46 that may be printed or otherwise applied to the substrate 26. A second conductive layer 48 may be printed or otherwise applied to the semiconductor ink 44. The first conductive layer 46 may correspond to various conductive materials application the substrate 26, which may corresponds to a thin, polymeric material. The semiconductor ink 44 may correspond to a liquid suspension comprising a concentration of LED light sources 18 dispersed therein. The second conductive layer 48 may correspond to a substantially light transmissive conductive material, for example a transparent conducting oxide (TCO), which may be in the form of indium tin oxide (ITO), fluorine doped tin oxide (FTO), and/or doped zinc oxide. The first conductive layer 46 may be in conductive communication with the first electrode 30 via a first conductive connection 50*a*, 50*b*, and the second conductive layer 48 may be in conductive communication with the second electrode 32 via a second conductive connection 52*a*, 52*b*.

Referring now to FIGS. 2A and 2B in some embodiments, the conductive connections 50*a*, 50*b*, 52*a*, and 52*b* may correspond to one of more layers of conductive material. The conductive connections 50*a*, 50*b*, 52*a*, and 52*b* may be printed as one more layers formed during a printing operation of the assemblies l0*a* and 10*b*. In this configuration, the conductive connections 50*a*, 50*b*, 52*a*, and 52*b* may be formed sequentially as a plurality of layers printed during a printing process concurrently with corresponding layers of the LED strip 20.

Referring to FIG. 2A, the first lighting assembly 10*a* is shown. In the exemplary embodiment depicted, the first conductive connection 50*a* and the second conductive connection 52*a* may extend from the electrodes 30 and 32 to each of the respective conductive layers 46 and 48. The conductive connections 50*a* and 52*a* may abut a first interface surface 46*a* of the first conductive layer 46 and a second interface surface 48*a* of the second conductive layer 48. The interface surfaces 46*a* and 48*a* may correspond to surfaces contacting one or more layers of the LED strip 20 (e.g. the semiconductor ink 44, the substrate 28, etc.). In this configuration, the conductive connections 50*a* and 52*a* may provide for a significantly uniform conduction of current to the LED light sources 18.

Referring to FIG. 2B, the second lighting assembly 10*b* is shown. In some embodiments, the first conductive connection 50*b* and the second conductive connection 52*b* may extend from the electrodes 30 and 32 to each of the respective conductive layers 46 and 48. The conductive connections 50*b* and 52*b* may abut a first edge portion 46*b* of the first conductive layer 46 and a second edge portion 48*b* of the second conductive layer 48. The edge portions 46*b* and 48*b* may correspond to surfaces extending along a perimeter of each of the conductive layers 46 and 48. In this configuration, the conductive connections 50*b* and 52*b* may provide for a significantly uniform conduction of current to the LED light sources 18.

Referring to FIG. 2C, the third lighting assembly 10*c* is shown. In some embodiments, the conductive connections 50 and 52 may be formed as a portion of the first electrode 30 and the second electrode 32, respectively. For example, alternatively or in addition to the conductive connections 50 and 52, the first electrode 30 and the second electrode 32 may form a first conductive protrusion 30*c* and a second conductive protrusion 32*c*. The conductive protrusions 30*c* and 32*c* may extend outward to abut the conductive layers 46 and 48 or form a portion of the conductive connections 50 and 52. The conductive protrusions 30*c* and 32*c* are shown abutting a first interface surface 46*c* and a second interface surface 48*c*. However, the conductive protrusions 30*c* and 32*c* may be configured similar to the conductive connections 50*b* and 52*b* and abut the edge portions 46*b* and 48*b*. The various embodiments discussed herein may provide for flexible solutions that may be configured for a variety of applications of the illumination apparatus 10.

The LED light sources 18 may correspond to micro-LEDs of gallium nitride elements, which may be approximately 5 microns to 400 microns across a width substantially aligned with the surface of the first electrode. The concentration of the LED light sources 18 may vary based on a desired emission intensity of the illumination apparatus 10. The LED light sources 18 may be dispersed in a random or controlled fashion within the semiconductor ink 44. The semiconductor ink 44 may include various binding and dielectric materials including but not limited to one or more of gallium, indium, silicon carbide, phosphorous and/or translucent polymeric binders. In this configuration, the semiconductor ink 44 may contain various concentrations of LED light sources 18 such that a surface density of the LED light sources 18 may be adjusted for various applications.

In some embodiments, the LED light sources 18 and semiconductor ink 44 may be sourced from Nth Degree Technologies Worldwide Inc. The semiconductor ink 44 can be applied through various printing processes, including ink jet and silk screen processes to selected portion(s) of the substrate 26. More specifically, it is envisioned that the LED light sources 18 are dispersed within the semiconductor ink 44, and shaped and sized such that a substantial quantity of them preferentially align with the first conductive layer 46 and a second conductive layer 48 during deposition of the semiconductor ink 44. The portion of the LED light sources 18 that ultimately are electrically connected to the conductive layers 46 and 48 may be illuminated by a voltage source applied across the first electrode 30 and the second electrode 32. In some embodiments, a power source operating at 12 to 16 VDC from a vehicular power source may be employed as a power source to supply current to the LED light sources 18. Additional information regarding the construction of a light producing assembly similar to the illumination apparatus 10 is disclosed in U.S. Pat. No. 9,299,887 to Lowenthal et al., entitled "ULTRA-THIN PRINTED LED LAYER REMOVED FROM SUBSTRATE," filed Mar. 12, 2014, the entire disclosure of which is incorporated herein by reference.

At least one dielectric layer 56 may be printed over the LED light sources 18 to encapsulate and/or secure the LED light sources 18 in position. In some embodiments, a photoluminescent layer 60 may be applied to the second conductive layer 48 to form a backlit configuration of the illumination apparatus 10. The photoluminescent layer 60 may be applied as a coating, layer, film, and/or photoluminescent substrate to the second conductive layer 48, and in some implementations may be applied to the dielectric layer 56 or be combined with the dielectric layer 56. As described herein, the LED strip may comprise each of the following elements as described herein: the substrate 26, the first conductive layer 46, the LED light sources 18 in the semiconductor ink 44, the second conductive layer 48, the dielectric layer 56, and the photoluminescent layer 60. In this configuration, the LED strip 20 may be dispensed from a reel for inclusion in the illumination apparatus 10 as discussed further in reference to FIG. 3.

In various implementations, the LED light sources 18 may be configured to emit an excitation emission comprising a first wavelength corresponding to blue light. The LED light sources 18 may be configured to emit the excitation emission into the photoluminescent layer 60 such that the photoluminescent material becomes excited. In response to the receipt of the excitation emission, the photoluminescent material converts the excitation emission from the first wavelength to the output emission 24 comprising at least a second wavelength longer than the first wavelength. Additionally, one or more coatings or sealing layers may be applied to an exterior surface of the LED strip 20 to protect the photoluminescent layer 60 and various other portions of the LED strip 20 from damage and wear.

In an exemplary implementation, the excitation emission may correspond to a blue, violet, and/or ultra-violet spectral color range. The blue spectral color range comprises a range of wavelengths generally expressed as blue light (~440-500 nm). In operation, the excitation emission may be transmitted into an at least partially light transmissive material of the photoluminescent layer 60. The excitation emission is emitted from the LED light sources 18 and may be configured such that the first wavelength corresponds to at least one absorption wavelength of one or more photoluminescent materials disposed in the photoluminescent layer 60.

The output emission 24 may correspond to a plurality of wavelengths. Each of the plurality of wavelengths may correspond to significantly different spectral color ranges. For example, the at least second wavelength of the output emission 24 may correspond to a plurality of wavelengths (e.g. second, third, etc.). In some implementations, the plurality of wavelengths may be combined in the output emission 24 to appear as substantially white light. The plurality of wavelengths may be generated by a red-emitting photoluminescent material having a wavelength of approximately 620-750 nm, a green emitting photoluminescent material having a wavelength of approximately 526-606 nm, and a blue or blue green emitting photoluminescent material having a wavelength longer than the first wavelength $\lambda_1$ and approximately 430-525 nm.

The photoluminescent materials, corresponding to the photoluminescent layer 60 or the energy conversion layer 54, may comprise organic or inorganic fluorescent dyes configured to convert the excitation emission to the output emission 24. For example, the photoluminescent layer 60 may comprise a photoluminescent structure of rylenes, xanthenes, porphyrins, phthalocyanines, or other materials suited to a particular Stokes shift defined by an absorption range and an emission fluorescence. In some embodiments, the photoluminescent layer 60 may be of at least one inorganic luminescent material selected from the group of phosphors. The inorganic luminescent material may more particularly be from the group of Ce-doped garnets, such as YAG:Ce. As such, each of the photoluminescent portions may be selectively activated by a wide range of wavelengths received from the excitation emission configured to excite one or more photoluminescent materials to emit an output emission having a desired color. Additional information regarding the construction of photoluminescent structures to be utilized in at least one photoluminescent portion of a vehicle is disclosed in U.S. Pat. No. 8,232,533 to Kingsley et al., entitled "PHOTOLYTICALLY AND ENVIRONMENTALLY STABLE MULTILAYER STRUCTURE FOR HIGH EFFICIENCY ELECTROMAGNETIC ENERGY CONVERSION AND SUSTAINED SECONDARY EMISSION," filed Jul. 31, 2012, the entire disclosure of which is incorporated herein by reference.

Figure 3:
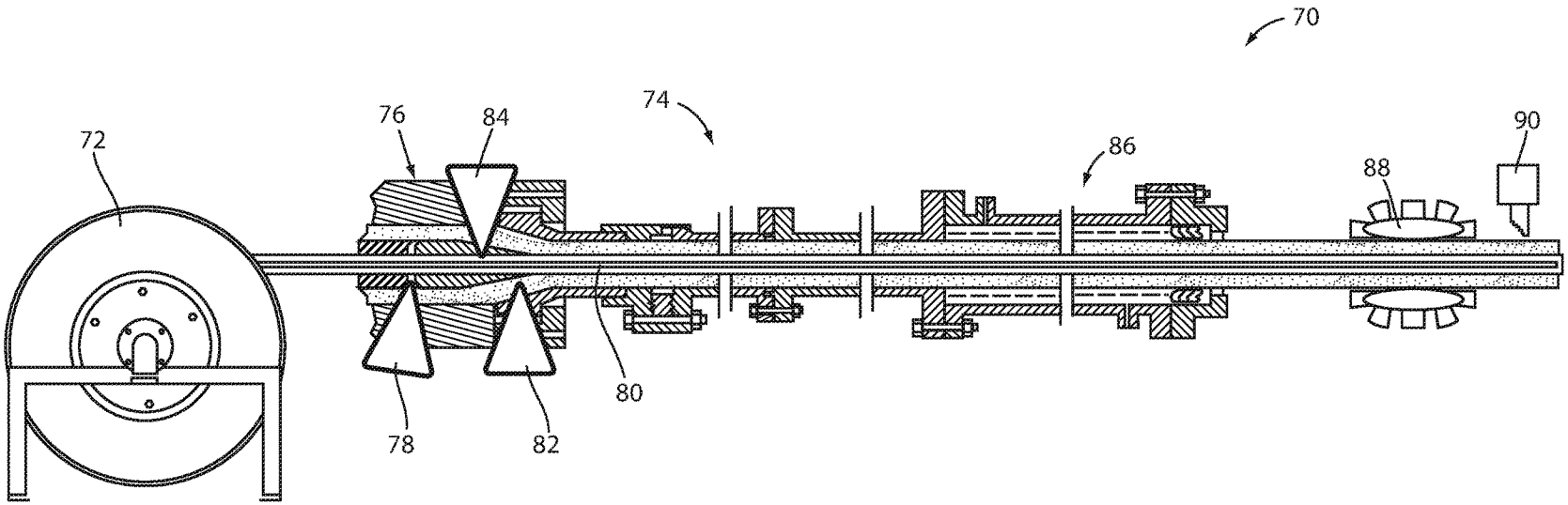
FIG. 3 is a schematic diagram of the method of manufacturing a lighting apparatus.

Referring now to FIG. 3, a diagram of an exemplary manufacturing process 70 for the manufacture of the illumination apparatus 10 is shown. As previously discussed, the LED strip 20 may be printed on the substrate 26, which may correspond to a thin-film polymer. The LED strip may be dispensed from a reel 72. The LED strip 20 may be fed into an extruder 74 wherein the LED strip 20 may receive the electrodes 30 and 32 as well as encapsulating layer 38 and the dielectric spacer 40 during an extrusion process. In this configuration, the heat conductive materials of the electrodes 30 and 32 as well as the dielectric spacer 40 may provide for heat energy to be transmitted away from the LED light sources 18.

The extruder 74 may comprise a dispensing portion 76 configured to dispense the electrodes 30 and 32 from a first supply hopper 78. Accordingly, the first supply hopper 78 may be configured to dispense the thermally and electrically conductive material into a barrel 80 of the extruder 74. The extruder 74 may dispense the thermally conductive and electrically insulating material of the dielectric spacer 40 into the barrel 80 from a second supply hopper 82. The extruder 74 may also dispense the at least partially light transmissive material of the encapsulating layer 38 or the cover portion from a third supply hopper 84. The extruder 74 and the corresponding extrusion process may also include the incorporation of additional portions of the illumination apparatus, which may include various materials and features of the illumination apparatus 10.

Once the electrodes 30 and 32, the dielectric spacer 40, and the encapsulating layer 38 are dispensed on the LED strip 20, the extruder 74 may form and extrude each of the materials to form various cross-sectional profile shapes, for example as illustrated in FIG. 1. The first electrode 30, the second electrode 32, and/or the dielectric spacer 40 may be formed in the extrusion process to form a plurality of protrusions 42*a*. Each of the protrusions 42*a* may form a cooling surface 42*b* and may correspond to a cooling fin. The protrusions 42*a* may be configured to increase the surface area of the cooling surface 42*b* for the heat conductive materials of the first electrode 30, the second electrode 32, and/or the dielectric spacer 40 to cool the LED strip 20. In this configuration, the first electrode 30, the second electrode 32, and/or the dielectric spacer 40 may form a heat sink having a cooling rate or volumetric cooling capacity that may be optimized to the cooling rate required for the LED strip 20.

The extrusion process may cool and form the profile shape of the illumination apparatus 10 in a cooling and forming portion 86. The cooling and forming portion may be configured to form the length L of the illumination apparatus in various shapes to suit particular applications. In the cooled state, the illumination apparatus 10 may be drawn from the extruder 74 by pull blocks 88 and cut to a desired length via a cut-off saw 90. Once cut to the desired length, the electrical leads 34 and 36 may be inserted into the electrodes 30 and 32 for connection to the controller 22. As discussed herein, the illumination apparatus provides for a cost-effective and flexible lighting assembly that may be utilized for a variety of applications.

Figure 4:
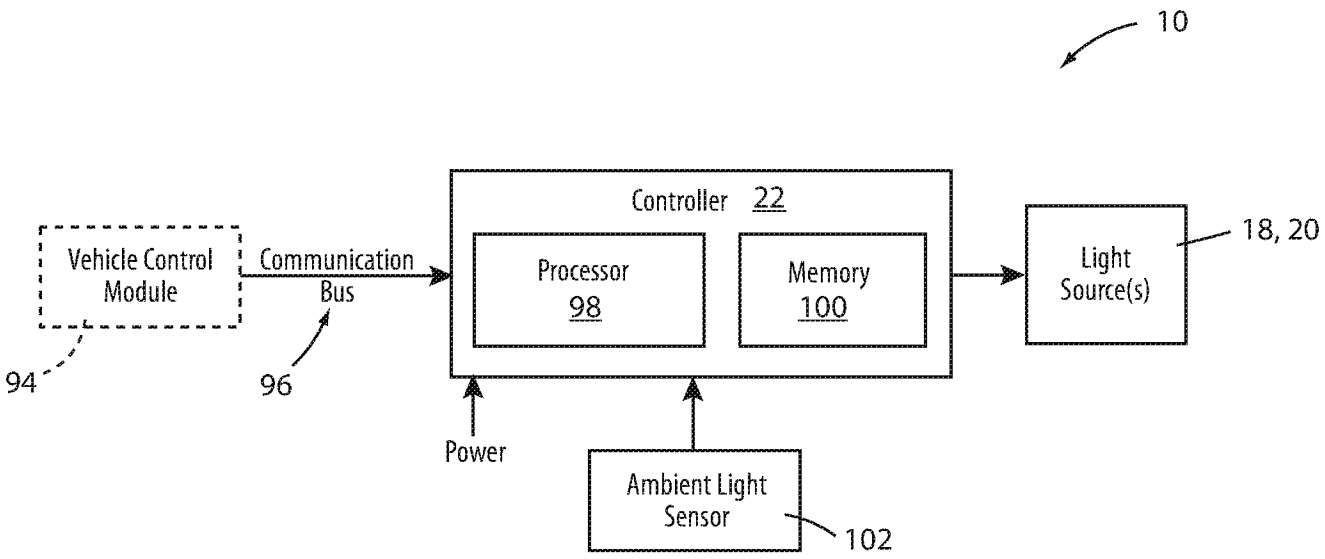
FIG. 4 is a block diagram of an illumination apparatus in accordance with the disclosure.

Referring to FIG. 4, a block diagram corresponding to the illumination apparatus 10 is shown. The controller 22 is in communication with the illumination apparatus 10 via the electrical supply busses discussed herein. The controller 22 may be in communication with the vehicle control module 94 via a communication bus 96 of the vehicle. The communication bus 96 may be configured to deliver signals to the controller 22 identifying various vehicle states. For example, the communication bus 96 may be configured to communicate to the controller 22 a drive selection of the vehicle, an ignition state, a door open or ajar status, a remote activation of the illumination apparatus 10, or any other information or control signals that may be utilized to activate or adjust the output emission 24. Though the controller 22 is discussed herein, in some embodiments, the illumination apparatus 10 may be activated in response to an electrical or electro-mechanical switch in response to a position of a closure (e.g. a door, hood, truck lid, etc.) of the vehicle.

The controller 22 may comprise a processor 98 comprising one or more circuits configured to receive the signals from the communication bus 96 and output signals to control the illumination apparatus 10 to control the output emission 24. The processor 98 may be in communication with a memory 100 configured to store instructions to control the activation of the illumination apparatus 10. The controller 22 may further be in communication with an ambient light sensor 102. The ambient light sensor 102 may be operable to communicate a light condition, for example a level brightness or intensity of the ambient light proximate the vehicle. In response to the level of the ambient light, the controller 22 may be configured to adjust a light intensity output from the illumination apparatus 10. The intensity of the light output from the illumination apparatus 10 may be adjusted by the controller 22 by controlling a duty cycle, current, or voltage supplied to the illumination apparatus 10.

For the purposes of describing and defining the present teachings, it is noted that the terms "substantially" and "approximately" are utilized herein to represent the inherent degree of uncertainty that may be attributed to any quantitative comparison, value, measurement, or other representation. The term "substantially" and "approximately" are also utilized herein to represent the degree by which a quantitative representation may vary from a stated reference without resulting in a change in the basic function of the subject matter at issue.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A light emitting assembly comprising:

a first electrode;

a second electrode extending parallel to the first electrode; and an LED strip comprising at least one photoluminescent layer disposed thereon, the LED strip comprising a plurality of LEDs in a semiconductor ink disposed on the first electrode and the second electrode and configured to emit a first emission, wherein the first electrode and the second electrode are of an electrically conductive polymer configured to transfer heat away from the plurality of LEDs.

2. The light emitting assembly according to claim 1, further comprising a dielectric spacer disposed between the first electrode and the second electrode.

3. The light emitting assembly according to claim 1, wherein the photoluminescent layer is configured to convert the first emission to a second emission.

4. The light emitting assembly according to claim 3, wherein the second emission corresponds to an output emission emitted from the light emitting assembly.

5. The light emitting assembly according to claim 1, wherein the electrically conductive polymer has an electrical conductivity of at least $1\times10^{-3}$ S/cm.

6. The light emitting assembly according to claim 1, wherein the electrically conductive polymer has a thermal conductivity of at least 5 W/mK.

7. An extruded light bar comprising:

a first electrode;

a second electrode;

a dielectric spacer separating the electrodes;

an LED strip disposed on a first surface formed by the first electrode, the second electrode, and the dielectric spacer;

a seal layer disposed over the LED strip; and wherein the first electrode and the second electrode are of an electrically conductive polymer configured to transfer heat away from the LED strip.

8. The light bar according to claim 7, wherein the LED strip comprises a plurality of LEDs printed in a semiconductor ink on a substrate.

9. The light bar according to claim 8, further comprising an electrical lead in electrically conductive communication with each of the first electrode and the second electrode.

10. The light bar according to claim 8, wherein the dielectric spacer corresponds to an electrically insulating heatsink.

11. The light bar according to claim 10, wherein the electrically insulating heatsink comprises the first surface in connection with the LED strip and a second surface comprising a plurality of protrusions.

12. The light bar according to claim 10, wherein a plurality of protrusions correspond to cooling fins.

13. The light bar according to claim 8, wherein the dielectric spacer is formed of a thermally conductive polymer.

14. The light bar according to claim 8, wherein the thermally conductive polymer has a thermal conductivity of at least 5 W/mK.

15. An extruded light bar comprising:

a first electrode;

a second electrode;

a dielectric spacer separating the electrodes; and an LED strip disposed on a substrate surface formed by the first electrode, the second electrode, and the dielectric spacer; and wherein the first electrode, the second electrode, and the dielectric spacer are of a plurality of polymers configured to transfer heat away from the LED strip.

16. The light bar according to claim 15, wherein the first electrode comprises a first cooling surface opposite the substrate surface, the first cooling surface comprising a first plurality of protrusions.

17. The light bar according to claim 16, wherein the second electrode comprises a second cooling surface opposite the substrate surface, the second cooling surface comprising a second plurality of protrusions.

18. The light bar according to claim 17, wherein the dielectric spacer comprises a third cooling surface comprising a third plurality of protrusions.

19. The light bar according to claim 17, wherein the first cooling surface, the second cooling surface, and the third cooling surface are approximately coplanar and the pluralities of protrusions form cooling fins formed of the plurality of polymers.

* * * * *